US006655608B2

(12) United States Patent
Hornby

(10) Patent No.: US 6,655,608 B2
(45) **Date of Patent: *Dec. 2, 2003**

(54) BALL VALVE FUEL INJECTOR

(75) Inventor: Michael J. Hornby, Williamsburg, VA (US)

(73) Assignee: Siemens Automotive Corporation, Auburn Hills, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 46 days.

This patent is subject to a terminal disclaimer.

(21) Appl. No.: 09/492,791

(22) Filed: Jan. 28, 2000

(65) Prior Publication Data

US 2002/0066805 A1 Jun. 6, 2002

Related U.S. Application Data

(63) Continuation of application No. 08/997,274, filed on Dec. 23, 1997, now Pat. No. 6,047,907.

(51) Int. Cl.[7] ..... F02M 51/00

(52) U.S. Cl. ..... 239/585.1; 239/585.4; 239/900

(58) Field of Search ..... 239/585.1, 585.2, 239/900, 584, 583, 569, 1, 5

(56) References Cited

U.S. PATENT DOCUMENTS

| | | | | |
|---|---|---|---|---|
| 4,342,427 A | * | 8/1982 | Gray | 239/585.2 |
| 4,564,145 A | * | 1/1986 | Takada et al. | 239/585.4 |
| 4,915,350 A | | 4/1990 | Babitzka et al. | 251/129.15 |
| 4,944,486 A | * | 7/1990 | Babitzka | 239/585.1 |
| 4,984,744 A | | 1/1991 | Babitzka et al. | 239/585 |

(List continued on next page.)

FOREIGN PATENT DOCUMENTS

| | | | | |
|---|---|---|---|---|
| DE | 195 03 224 A1 | * | 8/1996 | 239/585.1 |
| EP | 0 215 527 A1 | * | 3/1987 | 239/585.1 |
| EP | 0 398 157 A2 | * | 11/1990 | 239/585.1 |
| WO | WO 98 05861 A | | 2/1998 | |
| WO | WO 99 66196 A | | 12/1999 | |

*Primary Examiner*—Christopher Kim

(57) ABSTRACT

A solenoid actuated fuel injector includes a valve body, a valve seat at one end of the valve body and having a seating surface facing the interior of the valve body and including a fuel outlet opening, a fuel tube for conducting pressurized fuel into the valve body against the seating surface, a spherical valve ball moveable between a seated position against the seating surface to close the outlet opening against fuel flow, and an open position spaced from the seating surface to allow fuel flow through the outlet opening, a spring in the valve body and biasing the valve ball toward the seated position, an armature axially moveable in the valve body and including a valve ball capturing member at an end proximate the seating surface, the valve ball capturing member being engageable with the ball outer surface adjacent the seating surface, and a solenoid coil operable to draw the armature away from the seating surface, thereby moving the valve ball to the open position and allowing fuel to pass through the fuel outlet opening, deactivation of the solenoid coil allowing the biasing to return the valve ball to the seated position against the seating surface and to align itself in the seated position, thereby closing the outlet opening against the passage of fuel. A method of assembling the solenoid actuated fuel injector includes the steps of assembling a valve group subassembly, assembling a coil group subassembly, assembling together the valve group sub-assembly and coil group subassembly, and snap fastening together cooperating snap features on the valve group and coil group subassemblies.

6 Claims, 4 Drawing Sheets

U.S. PATENT DOCUMENTS 5,054,691 A * 10/1991 Huang et al. ..... 239/585.3
5,076,499 A * 12/1991 Cranford ..... 239/585.2
5,190,221 A * 3/1993 Reiter ..... 239/585.1
5,211,341 A * 5/1993 Wieczorek ..... 239/585.3
5,236,174 A 8/1993 Vogt et al. ..... 251/129.21
5,275,341 A 1/1994 Romann et al. ..... 239/585.4
5,289,627 A * 3/1994 Cerny et al. ..... 239/585.5 X
5,340,032 A 8/1994 Stegmaier et al. ..... 239/575
5,494,224 A 2/1996 Hall et al. ..... 239/585.5
5,494,225 A 2/1996 Nally et al. ..... 239/585.5
5,544,816 A * 8/1996 Nally et al. ..... 239/585.5
5,566,920 A 10/1996 Romann et al. ..... 251/129.21
5,580,001 A 12/1996 Romann et al. ..... 239/585.4
5,692,723 A 12/1997 Baxter et al. ..... 251/129.21
5,718,387 A 2/1998 Awarzamani et al. .... 239/585.1
5,732,888 A 3/1998 Maier et al. ..... 239/585.1
5,755,386 A * 5/1998 Lavan et al. ..... 239/585.4
5,758,826 A * 6/1998 Nines ..... 29/585.1
5,769,965 A 6/1998 Liedtke et al. ..... 148/121
5,775,600 A 7/1998 Wildeson et al. ..... 239/585.4
5,785,251 A * 7/1998 Wood et al. ..... 239/417.3
5,823,446 A * 10/1998 Bennett et al. ..... 239/585.1
5,875,975 A 3/1999 Reiter et al. ..... 239/585.1
5,915,626 A 6/1999 Awarzamani et al. ..... 239/135
5,927,613 A 7/1999 Koyanagi et al. ..... 239/585.1
5,937,887 A 8/1999 Baxter et al. ..... 137/15
5,975,436 A 11/1999 Reiter et al. ..... 239/585.1
5,979,866 A 11/1999 Baxter et al. ..... 251/129.21
5,996,227 A 12/1999 Reiter et al. ..... 29/888.45
5,996,910 A 12/1999 Takeda et al. ..... 239/585.1
5,996,911 A 12/1999 Gesk et al. ..... 239/585.1
6,003,790 A 12/1999 Fly ..... 239/533.9
6,012,655 A 1/2000 Maier ..... 239/585.4
6,019,128 A 2/2000 Reiter ..... 137/549
6,027,049 A 2/2000 Stier ..... 239/585.1
6,039,271 A 3/2000 Reiter ..... 239/585.4
6,047,907 A * 4/2000 Hornby ..... 239/585.1
6,076,802 A 6/2000 Maier ..... 251/129.21
6,079,642 A 6/2000 Maier ..... 239/585.1
6,089,475 A 7/2000 Reiter et al. ..... 239/585.1
6,186,472 B1 2/2001 Reiter ..... 251/129.21
6,201,461 B1 3/2001 Eichendorf et al. ..... 335/256

* cited by examiner

BALL VALVE FUEL INJECTOR

CROSS-REFERENCE TO RELATED APPLICATION

This application is a continuation of U.S. patent application Ser. No. 08/997,274, filed Dec. 23, 1997, now U.S. Pat. No. 6,047,907 which is hereby incorporated by reference herein in its entirety.

FIELD OF THE INVENTION

This invention relates to solenoid operated fuel injectors of the spherical valve ball type used to control the injection of fuel into an internal combustion engine;

BACKGROUND OF THE INVENTION

It is known in the fuel injection art to utilize a spherical valve ball within a solenoid operated fuel injector to close a fuel passageway in the injector. In such injectors, it is common to fabricate a flat on the ball valve and use the ball in combination with a collar that provides an annular cradling surface for the ball. A spring disc interfaces with the ball and urges the ball into an open position. Fuel is communicated around an armature and through the spring disc to establish fuel flow when the ball is in an unseated position. The ball must be guided to center itself on a seat of the fuel passageway and the armature requires a surface to keep the ball at least proximately concentric within the axis within the radial confinement imposed on the ball by the tip end of the armature.

With such assemblies, the dynamic flow rate of the fuel is set through the spring rate and selecting the spring becomes critical. These injectors require a non-magnetic plug in the bottom of their armatures to reduce wear and have a coil that is contacted by the fuel.

SUMMARY OF THE INVENTION

The present invention provides a solenoid actuated fuel injector having a simplified construction wherein a return spring biases a spherical valve ball onto a seating surface and, upon actuation of a solenoid coil, an armature picks the valve ball off the seat. When the coil is deactivated, the armature releases the ball, allowing the ball to return to the center of the seating surface.

According to the invention, the solenoid actuated fuel injector comprises a housing having a longitudinal axis and a valve body fixed to the housing. The valve body has a cylindrical sidewall coaxial with the housing longitudinal axis that laterally bounds the interior of the valve body. A valve seat at one end of the valve body includes a seating surface facing the interior of the valve body. The seating surface includes a fuel outlet opening centered on the axis and is in communication with means for conducting pressurized fuel into the valve body against the seating surface. The seating surface may be frustoconically shaped or of a concave shape.

A spherical valve ball within the injector is moveable between a seated position, wherein the ball is urged against the seating surface to close the outlet opening against fuel flow, and an open position, wherein the ball is spaced from the seating surface to allow fuel flow through the outlet opening. Biasing means, such as a coil spring, in the valve body is provided for biasing the valve ball toward the seated position.

An armature axially moveable in the valve body includes valve ball capturing means at an end proximate the seating surface. The valve ball capturing means engages with the ball outer surface adjacent the seating surface. A solenoid coil is operable to draw the armature away from the seating surface, thereby moving the valve ball to the open position and allowing fuel to pass through the fuel outlet opening. Deactivation of the solenoid coil allows the biasing means to return the valve ball to the seated position against the seating surface and to align itself in the seated position, thereby closing the outlet opening against the passage of fuel.

The armature includes an axially extending through-bore that allows fuel to pass and receives the valve ball. A fuel passage extending from the through-bore to an outer surface of the armature allows fuel to be communicated around the valve ball. The valve ball capturing means engages the ball at a diameter of the ball that is less than the major diameter of the ball and at a position between the major diameter of the ball and the seating surface. Herein the valve ball capturing means is an end of the armature wherein the through bore has a reduced diameter less than the major diameter of the ball. Alternatively the capturing means may be a plurality of fingers extending from the armature.

A method of assembling the solenoid actuated fuel injector comprises the steps of:

assembling a valve group subassembly;

assembling a coil group subassembly;

assembling together the valve group sub-assembly and coil group subassembly; and snap fastening together cooperating snap features on the valve group and coil group subassemblies.

These and other features and advantages of the invention will be more fully understood from the following detailed description of the invention taken together with the accompanying drawings.

DETAILED DESCRIPTION OF THE INVENTION

Figure 1:
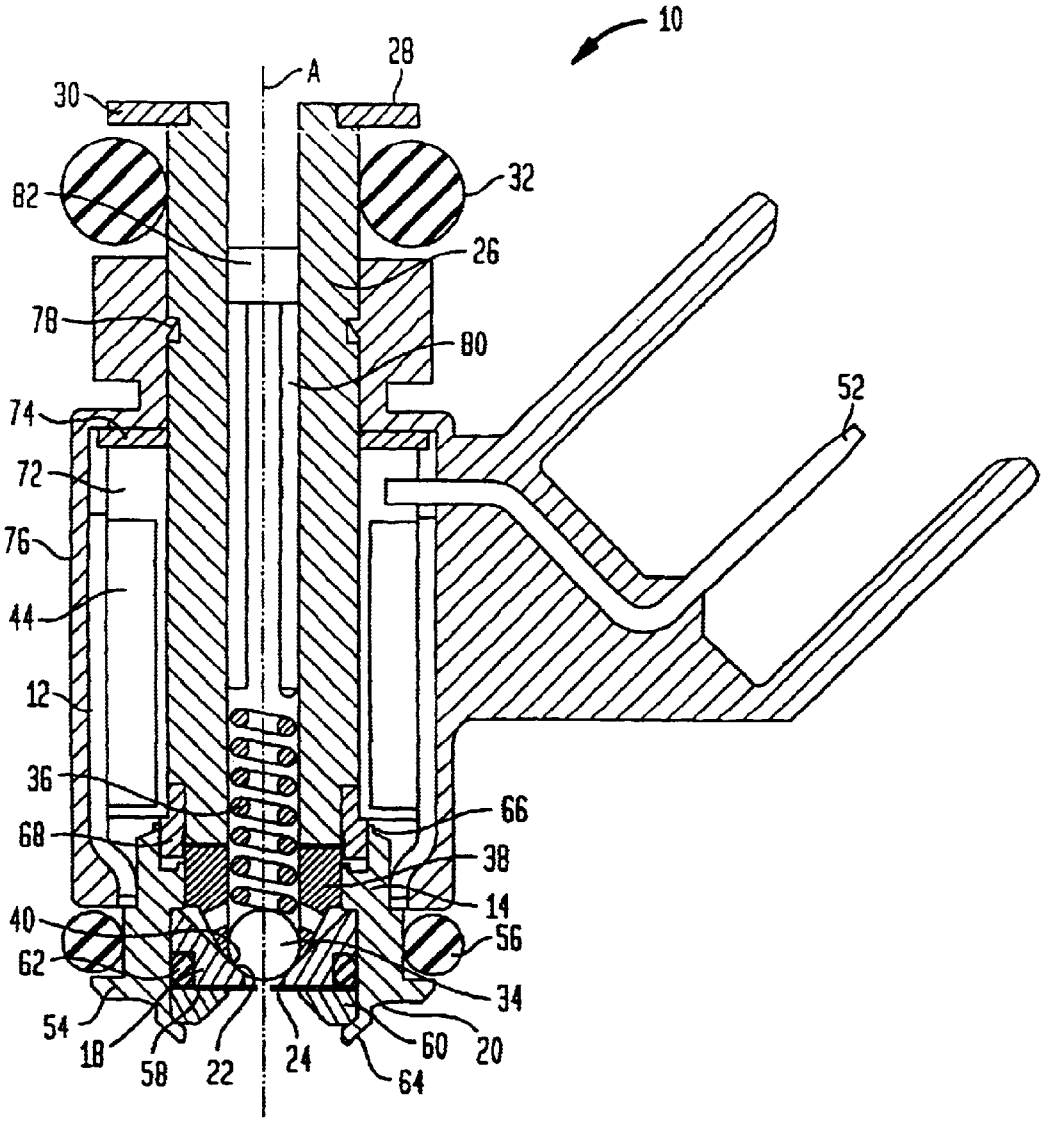
FIG. 1 is a sectional view of a solenoid actuated fuel injector of the ball valve type constructed in accordance with the present invention.

Referring now to the drawings in detail, numeral 10 generally indicates, a solenoid actuated fuel injector of the top feed type for use in an internal combustion engine. The fuel injector 10 includes a housing 12 having a longitudinal axis A and a valve body 14 fixed to the housing. The valve body 14 has a cylindrical sidewall 16 coaxial with the housing longitudinal axis A that laterally bounds the interior of the valve body 14.

A valve seat 18 at one end 20 of the valve body 14 includes a seating surface 22 of a frustoconical or concave shape facing the interior of the valve body. The seating surface 22 includes a fuel outlet opening 24 centered on the axis A and is in communication with an inlet connector or fuel tube 26 for conducting pressurized fuel into the valve body 14 against the seating surface 22. Fuel tube 26 includes a mounting end 28 having a retainer 30 for mounting the injector in a fuel rail (not shown) as is known. An o-ring 32 is used to seal the mounting end 28 in the fuel rail.

Figure 2:
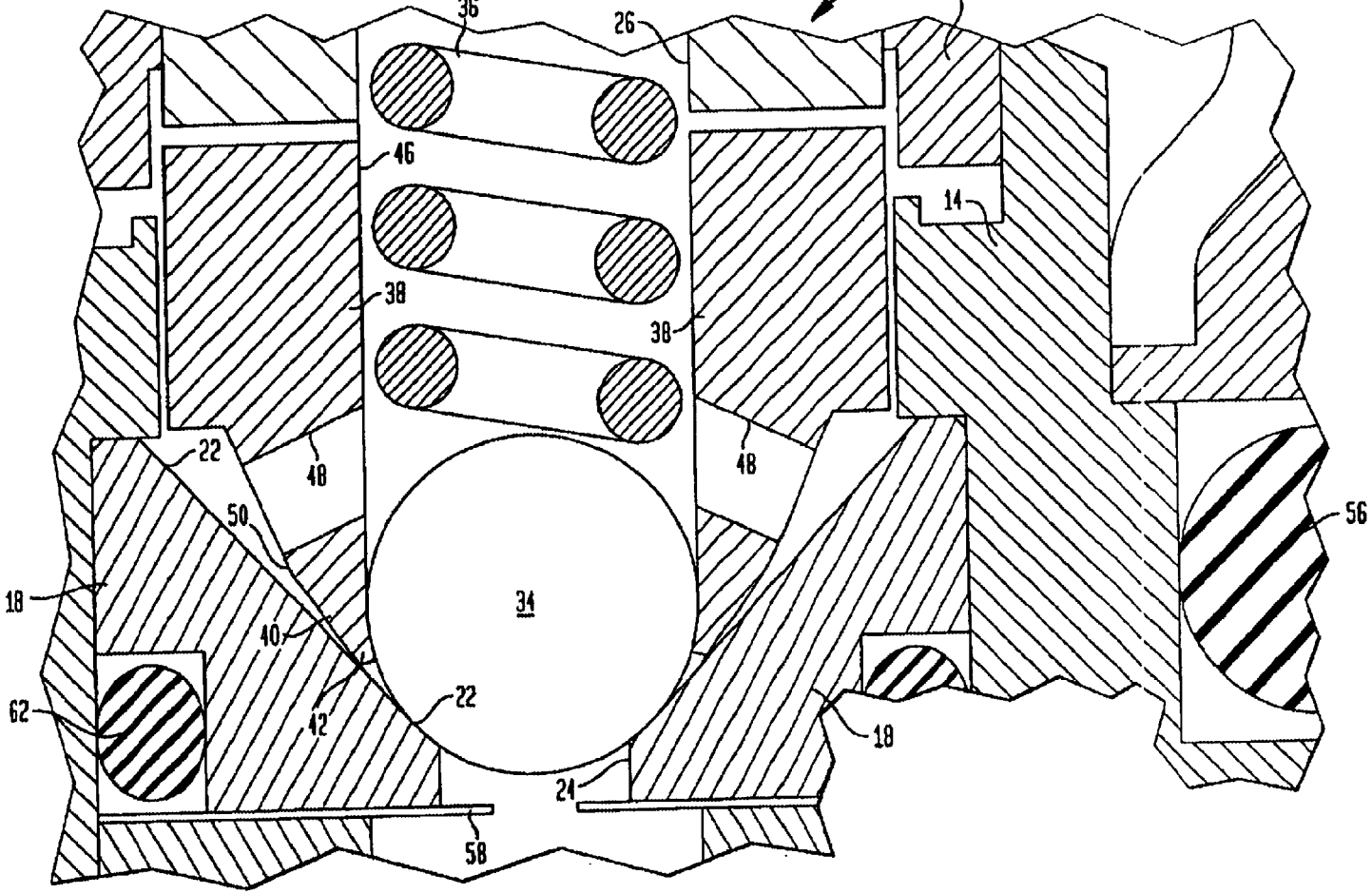
FIG. 2 is an enlarged sectional view of the solenoid actuated fuel injector of FIG. 1 illustrating the valve body assembly in a seated position of the valve ball and the armature resting on the seating surface.
Figure 3:
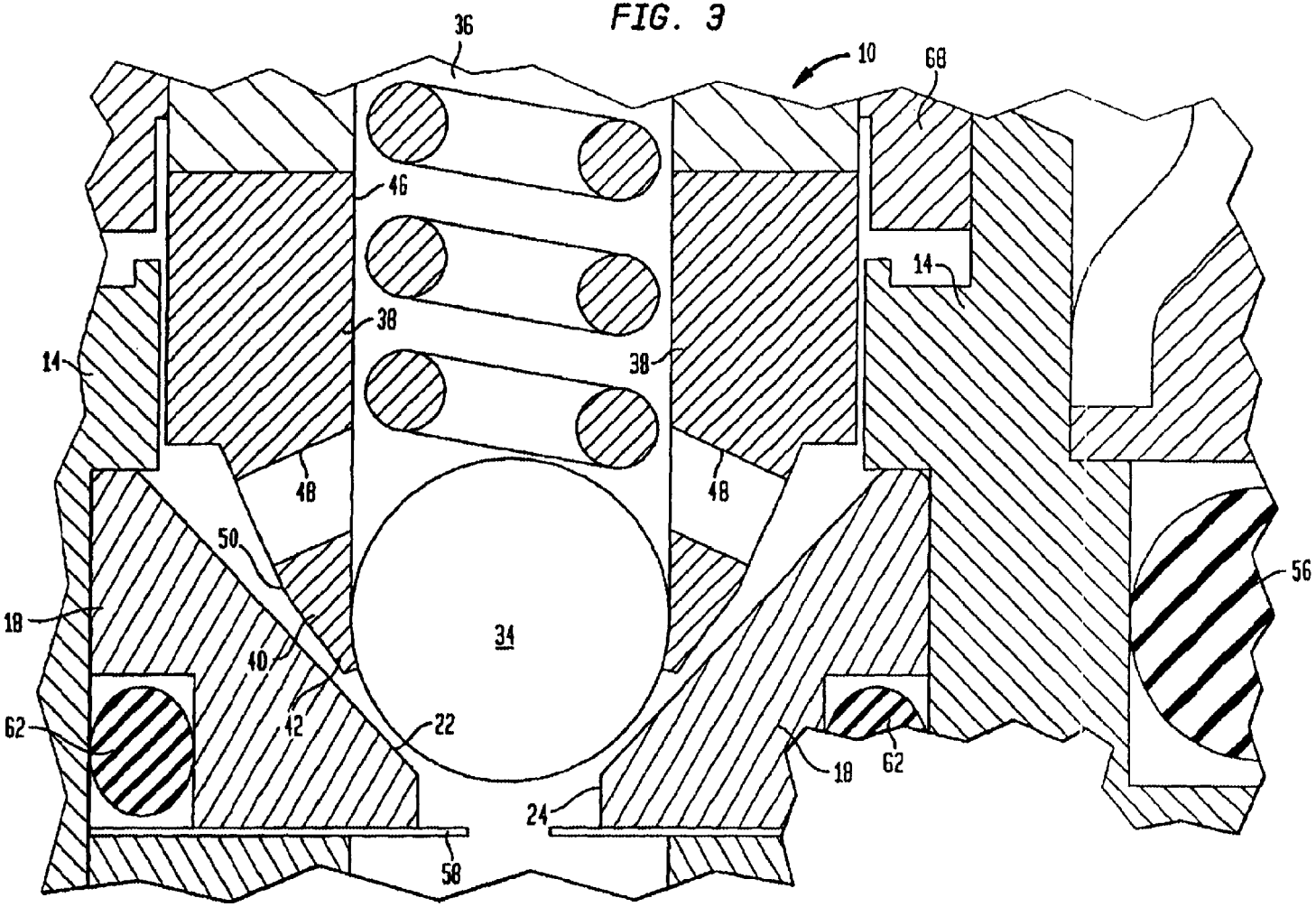
FIG. 3 is an enlarged sectional view of the solenoid actuated fuel injector of FIG. 1 illustrating the valve body assembly in an open position of the valve ball wherein the armature captured valve ball is raised off the seating surface.

A spherical valve ball 34 within the injector 10 is moveable between a seated position shown in FIG. 2, wherein the ball is urged against the seating surface 22 to close the outlet opening 24 against fuel flow, and an open position shown in FIG. 3, wherein the ball is spaced from the seating surface to allow fuel flow through the outlet opening. A spring 36, in valve body 14 is provided for biasing the valve ball 34 toward the seated position.

An armature 38 axially moveable in the valve body 14 includes valve ball capturing means 40 at an end 42 proximate the seating surface 22. The valve ball capturing means 40 engages with the ball 34 outer surface adjacent the seating surface 22 and rests on the seating surface in the seated position of the valve ball.

A solenoid coil 44 is operable to draw the armature 38 away from the seating surface 22, thereby moving the valve ball 34 to the open position, FIG. 3, and allowing fuel to pass through the fuel outlet opening 24. Deactivation of the solenoid coil 44 allows the spring 36 to return the valve ball 34 to the seated position, FIG. 2, against the seating surface 22 and to align itself in the seated position, thereby closing the outlet opening 24 against the passage of fuel.

The armature 38 includes an axially extending through-bore 46 that allows fuel to pass. Through-bore 46 also receives the valve ball 34 in a close tolerance fit yet allows the ball to move freely in the through-bore whereby the valve ball is self aligning upon seating. A fuel passage 48 extends from the through-bore 46 to the outer surface 50 of the armature 38, juxtaposed the seating surface 22, allowing fuel to be communicated around the valve ball 34.

The valve ball capturing means 40 engages the ball 34 at a diameter of the ball that is less than the major diameter of the ball and at a position between the major diameter of the ball and the seating surface 22. Herein the valve ball capturing means 40 is a reduced diameter aperture having a diameter less than the major diameter of the valve ball 34 on the axially extending through-bore 46 in the armature 38 or a plurality of fingers extending from the armature.

With further reference to FIG. 1, an electrical connector 52 is provided for connecting an electrical power supply (not shown) to power the armature 38. The valve body 14 includes a mounting end 54 for mounting the injector 10 in an intake manifold (not shown) as is known. An o-ring 56 is used to seal the mounting end 54 in the intake manifold. An orifice disk 58 may be provided proximate the outlet opening 24 for controlling the fuel communicated through the outlet opening. A back-up washer 60 is used to mount the orifice disk 58 in the valve body 14 and an o-ring 62 is mounted between valve body and valve seat 18 adjacent the orifice disk.

Injector 10 is made of two subassemblies that are each first assembled, then snapped together to form the injector.

Accordingly, the injector 10 includes a valve group subassembly and a coil subassembly as hereinafter more fully described.

In the valve group subassembly, the valve seat 18, o-ring 62, snap orifice disk 58 and backup washer 60 are loaded into the valve body 14, held in a desired position, and the end 64 of the valve body is bent inwardly. The valve ball 34 is placed into the armature 38 and the armature and valve ball are assembled in the valve body 14. A measurement is taken between the top 66 of the valve body 14 and the top of the armature 38 with the armature pulled up against the ball 34.

A non-magnetic sleeve 68 is pressed onto one end of the inlet connector 26 and the sleeve and inlet connector are laser welded together. The sleeve 68 and inlet connector 26 are then pressed into the valve body 14 and the sleeve and valve body are welded together completing the assembly of the valve group subassembly.

The coil group subassembly is constructed as follows. A plastic bobbin 72 is molded with straight terminals. Wire is wound around the plastic bobbin 72 and the bobbin assembly is placed into a metal can which defines the housing 12. A metal plate that defines the housing cover 74, is pressed into the housing 12. The terminals are bent to their proper location. The housing 12 and coil 44 assembly are then overmolded to complete the coil group subassembly.

The over-molded coil subassembly is then pressed and snapped onto the inlet connector 26 and held together by a snap feature 78 molded into the plastic over-mold 76. The upper o-ring retainer 30 is then installed and crimped into place on the inlet connector 26. The spring 36 and adjusting tube 80 are installed in the inlet connector 26 and the injector is calibrated by adjusting the relative positioning of the adjusting tube in the inlet connector and crimping the adjusting tube in place. A filter 82 is then mounted in the inlet connector 26.

Figure 4:
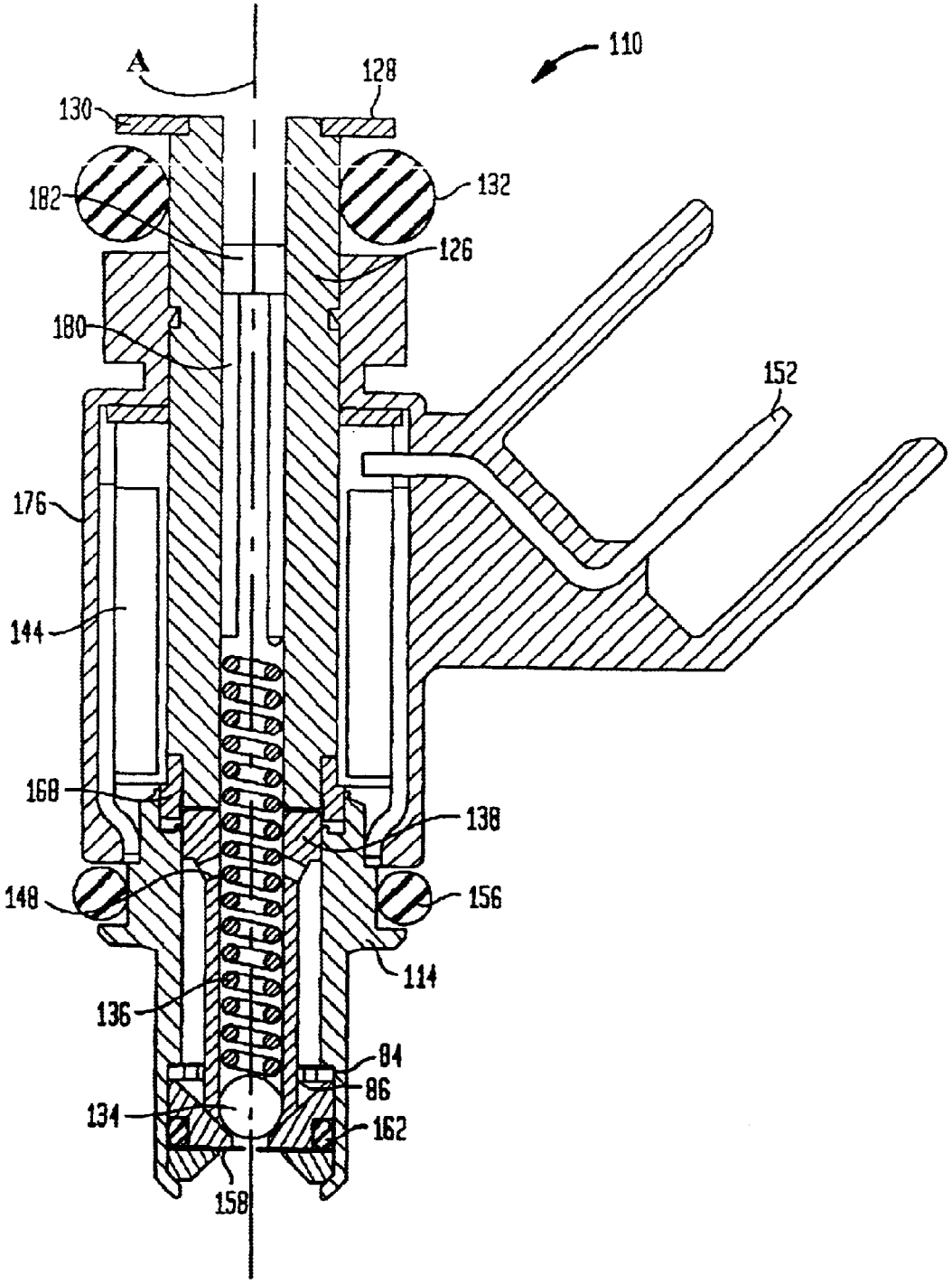
FIG. 4 is a sectional view of a solenoid actuated fuel injector of the ball valve type constructed in accordance with the present invention having an extended tip and illustrating a guide and lower screen incorporated into the injector.

FIG. 4 illustrates an alternative injector 110 having an extended tip section. In the description of injector 110 which follows, similar structure as previously referenced in FIGS. 1–3 is referred to by similar reference characters. Injector 110 includes a guide and screen member 84 mounted in the valve body 114. Guide and screen member 84 includes a centered aperture 86 for receiving and guiding the armature 138 and to keep the armature from moving off the longitudinal axis A during operation. Guide and screen 84 includes openings, preferably slotted openings of a size smaller than the injector opening, to allow fuel to pass and trap stray particles larger than the openings in the guide and screen.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method of assembling a fuel injector for use with an internal combustion engine, the method comprising:

assembling a valve group subassembly, the valve group subassembly including an inlet connector connected to a valve body;

assembling a coil group subassembly independently from the valve group subassembly, the coil group subassembly including a solenoid coil and an overmold; and fastening together cooperating fastening features on the valve group subassembly and the coil group subassembly.

2. The method according to claim 1, wherein the assembling the valve group subassembly further includes providing a valve body having a frustoconical sealing surface, and centering a spherical valve ball with the frustoconical sealing surface relative to longitudinal axis.

3. The method according to claim 1, wherein the assembling the valve group subassembly includes providing an armature and supporting a spherical valve ball with respect to the armature.

4. The method according to claim 1, wherein the assembling of the valve group subassembly further comprising disposing a non-magnetic sleeve between the inlet connector and the valve body.

5. A method of assembling a fuel injector for use with an internal combustion engine, the method comprising:

assembling a valve group subassembly, the valve group subassembly including an inlet connector connected to a valve body;

assembling a coil group subassembly independently from the valve group subassembly, the coil group subassembly including a solenoid coil and an overmold; and fastening together cooperating fastening features on the valve group subassembly and the coil group subassembly, wherein the assembling the valve group subassembly further includes providing an armature with an upstream portion, a downstream portion, and an intermediate portion between the upstream and downstream portions, and aligning a spherical valve ball and the downstream portion along a longitudinal axis.

6. The method according to claim 5, wherein the aligning comprises supporting the spherical valve ball at the downstream portion of the armature.

* * * * *